United States Patent [19]

Crews

[11] Patent Number: 4,501,441

[45] Date of Patent: Feb. 26, 1985

[54] TENSION HANGER LANDING BOWL

[75] Inventor: Mark E. Crews, Houston, Tex.

[73] Assignee: Cameron Iron Works, Inc., Houston, Tex.

[21] Appl. No.: 363,850

[22] Filed: Mar. 31, 1982

[51] Int. Cl.[3] ..... F16L 21/00

[52] U.S. Cl. ..... 285/143; 285/24; 285/39; 285/321

[58] Field of Search ..... 285/143, 142, 141, 140, 285/145, 144, 146, 147, 148, 321, 24, 39

[56] References Cited

U.S. PATENT DOCUMENTS

| | | | |
|---|---|---|---|
| 2,104,180 | 1/1938 | Barker | 285/143 X |
| 2,874,436 | 2/1959 | Allen | 285/146 X |
| 3,155,401 | 11/1964 | Musolf | 285/141 X |
| 3,284,111 | 11/1966 | Pinkard | 285/141 |
| 3,334,924 | 8/1967 | Todd | 285/145 X |
| 3,679,238 | 7/1972 | Putch | 285/144 |
| 4,278,278 | 7/1981 | Chambless et al. | 285/143 |

FOREIGN PATENT DOCUMENTS

| | | | |
|---|---|---|---|
| 974536 | 11/1964 | United Kingdom | 285/143 |

*Primary Examiner*—Dave W. Arola
*Attorney, Agent, or Firm*—Vinson & Elkins

[57] ABSTRACT

A wellhead assembly having a wellhead member with an internal shoulder providing an upper outer shoulder and a lower inner seat, and a plurality of pins threaded therethrough and a landing bowl of arcuate segments connected and biased apart at their facing ends to seat on the upper shoulder so that a tubing string may be run therethrough and moved inward by said pins to be above the lower inner seat for seating thereon to support a tubing string in tension therebelow.

4 Claims, 6 Drawing Figures

TENSION HANGER LANDING BOWL

BACKGROUND

Many wells now require the hanging of production tubing in tension. For example, a shallow well may require a tension set packer; wells using downhole pumps require hanging in tension for maximum pumping efficiency; and hanging tubing in tension decreases the effects of thermal expansion.

Generally wells now using tension hanging of tubing employ a means such as ram-type suspension. The cost of adding ram-type suspension to a tubing hanger is often prohibitive. U.S. Pat. No. 3,334,924 illustrates fluid activated slips for hanging a string. Other wells use a J slot and pin connection for hanging tubing in tension such as shown in U.S. Pat. No. 4,278,278. Such pin and J slot arrangement requires that the pins be aligned with the slots as the string is tensioned and that the string be rotated after tensioning to move the pins to the short leg of the J slot. Such orientation and rotation can create problems in achieving proper tensioning.

SUMMARY

The present invention relates to an improved landing bowl assembly for supporting a string in tension within the well bore. The improved landing bowl assembly of the present invention includes at least two bowl segments having an internal upwardly facing landing shoulder, means connecting and biasing the segments outward, a wellhead member having a plurality of radially directed energizing screws therein, and a groove in the exterior of said segments in which said screws engage, said screws having first and second stops to control the inward movement of said segments. The first of said position allowing the shoulder of the string to be supported to pass therethrough and the second position engaging and supporting said string shoulder.

An object of the present invention is to provide an improved wellhead assembly for supporting a tubing string in tension which is of simple and economic structure.

Another object is to provide an improved wellhead assembly for hanging a production string in tension which does not require rotation of the tubing string.

A further object is to provide an improved split landing bowl of simple construction and which is easy to use and ensures proper support of the tubing string in tension.

BRIEF DESCRIPTION OF THE DRAWINGS

These and other objects and advantages of the present invention are hereinafter set forth with respect to the drawings wherein.

DESCRIPTION OF THE PREFERRED EMBODIMENT

Figure 1:
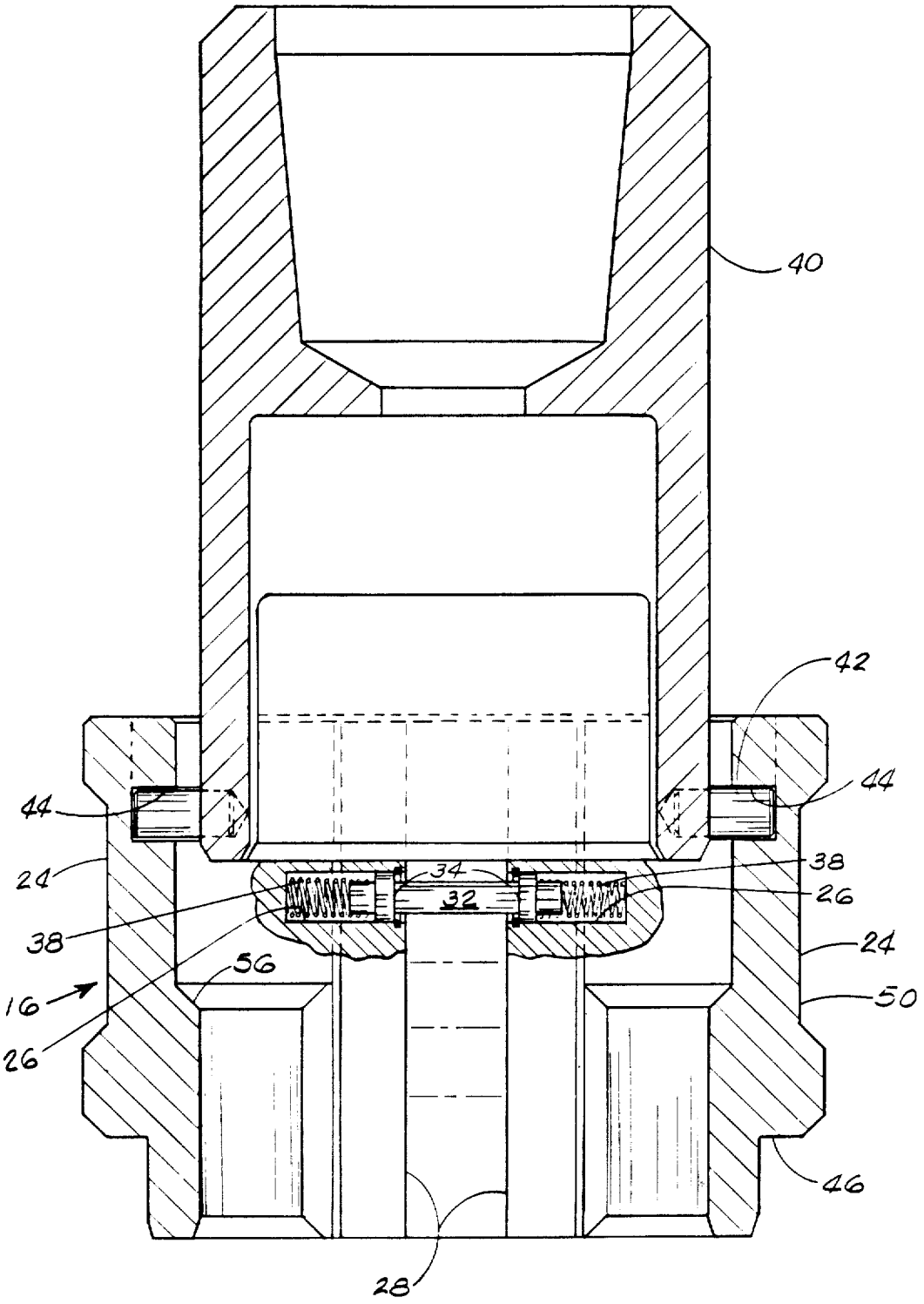
FIG. 1 is an axial sectional view of the improved landing bowl of the present invention supported in a running tool.

The improved wellhead assembly 10 as best shown in FIGS. 2 through 5 includes wellhead 12 having seat assembly 14 mounted therein having an internal shoulder and landing bowl assembly 16. Seat assembly 14 is secured within wellhead 12 by tie-down screws 18 and its upper end includes lip 20 and inner upwardly facing seat 22.

Figure 2:
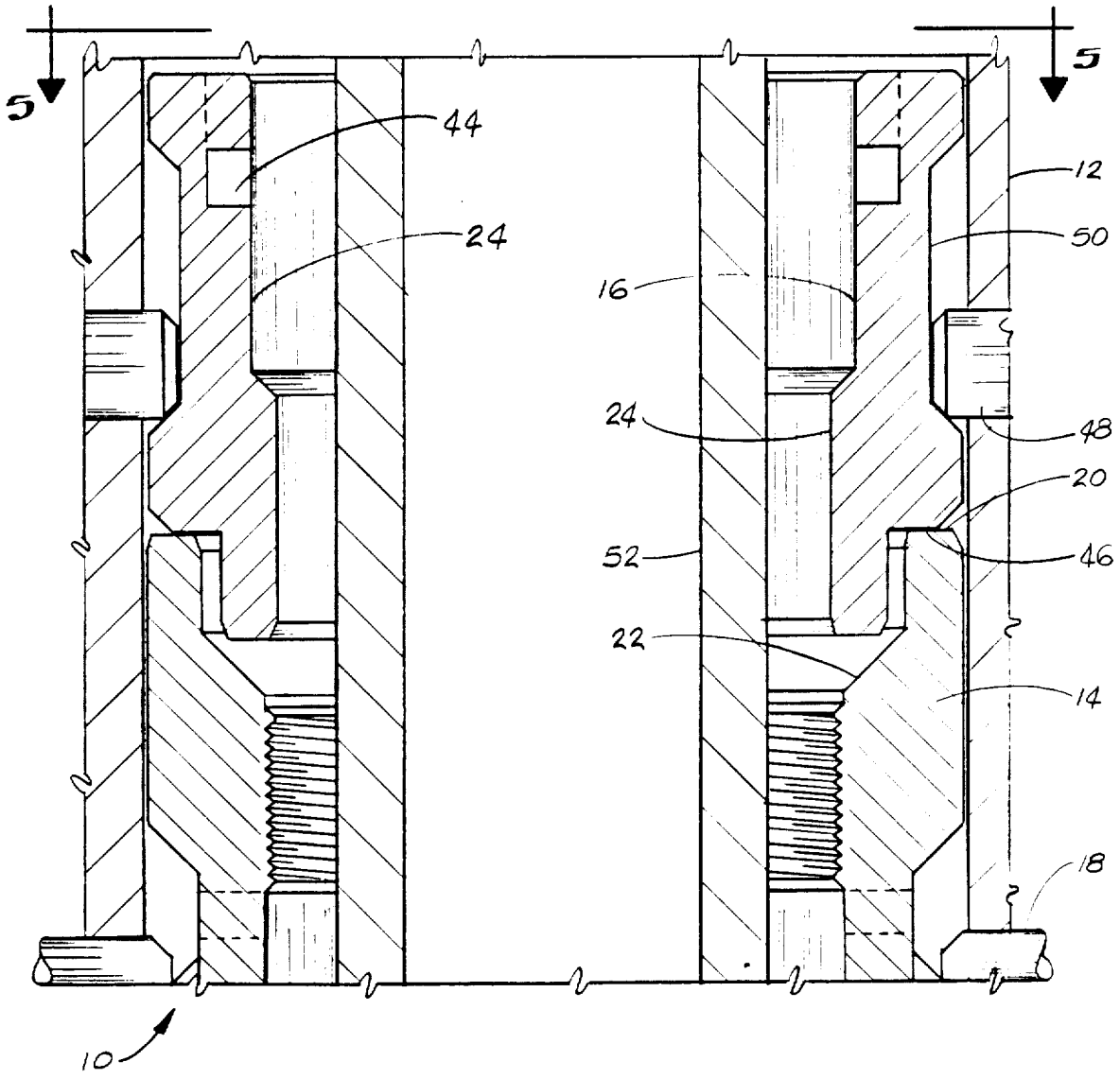
FIG. 2 is another sectional view of the landing bowl landed in a wellhead and engaged by energizing pins threaded through the wellhead member and with the tubing string being run therethrough.
Figure 5:
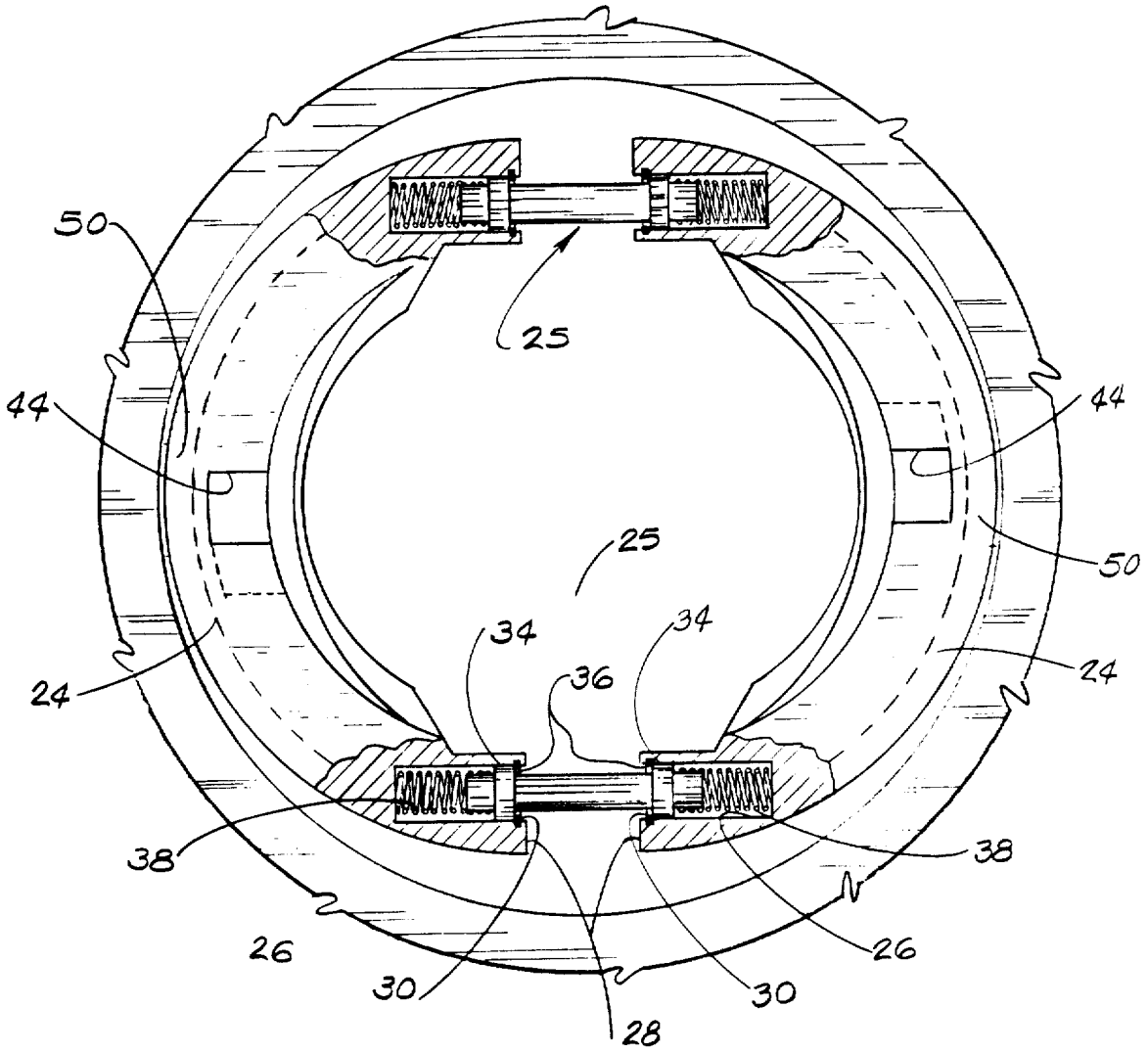
FIG. 5 is a transverse sectional view taken along line 5—5 in FIG. 2 to illustrate the bowl structure.

Landing bowl assembly 16 as best seen in FIGS. 1 and 5 includes segments 24 and means 25 connecting the segments 24 together and biasing them outwardly. Each of segments 24 includes recesses 26 at its end surfaces 28 with grooves 30 immediately inside the outer openings of recesses 26. Pins 32 have collars 34 near each end. The ends of pins 32 are positioned within facing recesses 26 of the mating segments 24 and snap rings 36 fit in grooves 30 to retain the ends of pins 32 including collars 34 within recesses 26. Springs 38 are positioned at the bottom of recesses 26 and engage collars 34 to urge pins 32 outward. Thus, segments 24 have an outer position, such as shown in FIGS. 1, 2 and 5 wherein collars 34 abut snap rings 36.

In FIG. 1 running tool 40 is connected to landing bowl assembly 16 by engagements of pins 42 in J-slots 44 on the interior of segments 24. With running tool 40 connected, landing bowl assembly 16 is lowered or run into a wellhead 12 until downwardly facing shoulders 46 on segments 24 seat on the upper end of lip 20 as shown in FIG. 2. Suitable orienting means is provided to assure proper engagement of segments 24 by energizing pins 48. In this position energizing pins 48 are threaded inward through wellhead 12 to their first stop, as hereinafter explained so that they are in engagement with the lower portion of grooves 50 in the exterior of segments 24. Then tubing string 52 is run therethrough.

Figure 3:
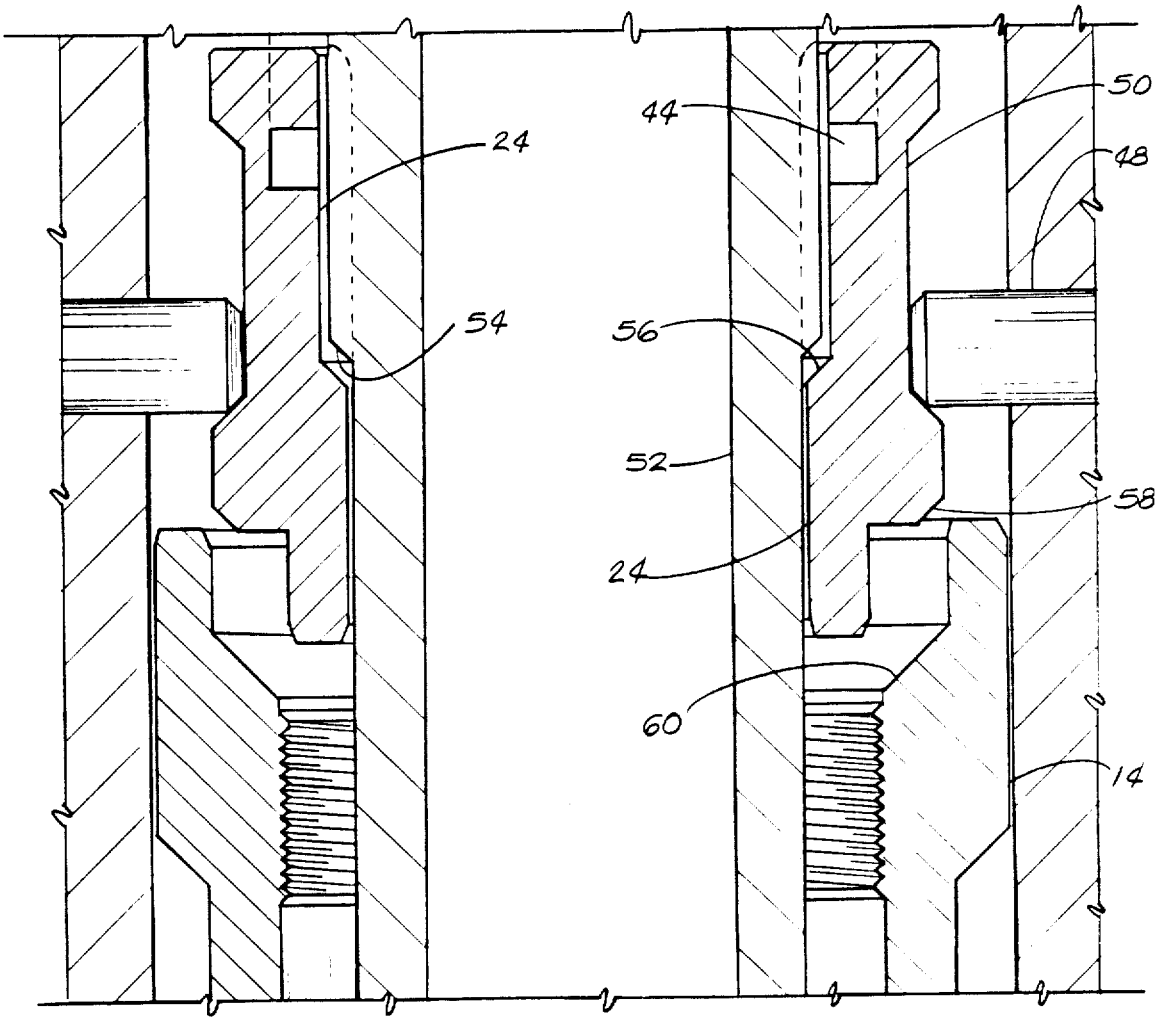
FIG. 3 is another sectional view illustrating the tubing string held in tension with its landing shoulder above the bowl seat and with the bowl moved inward by the energizing pins.
Figure 4:
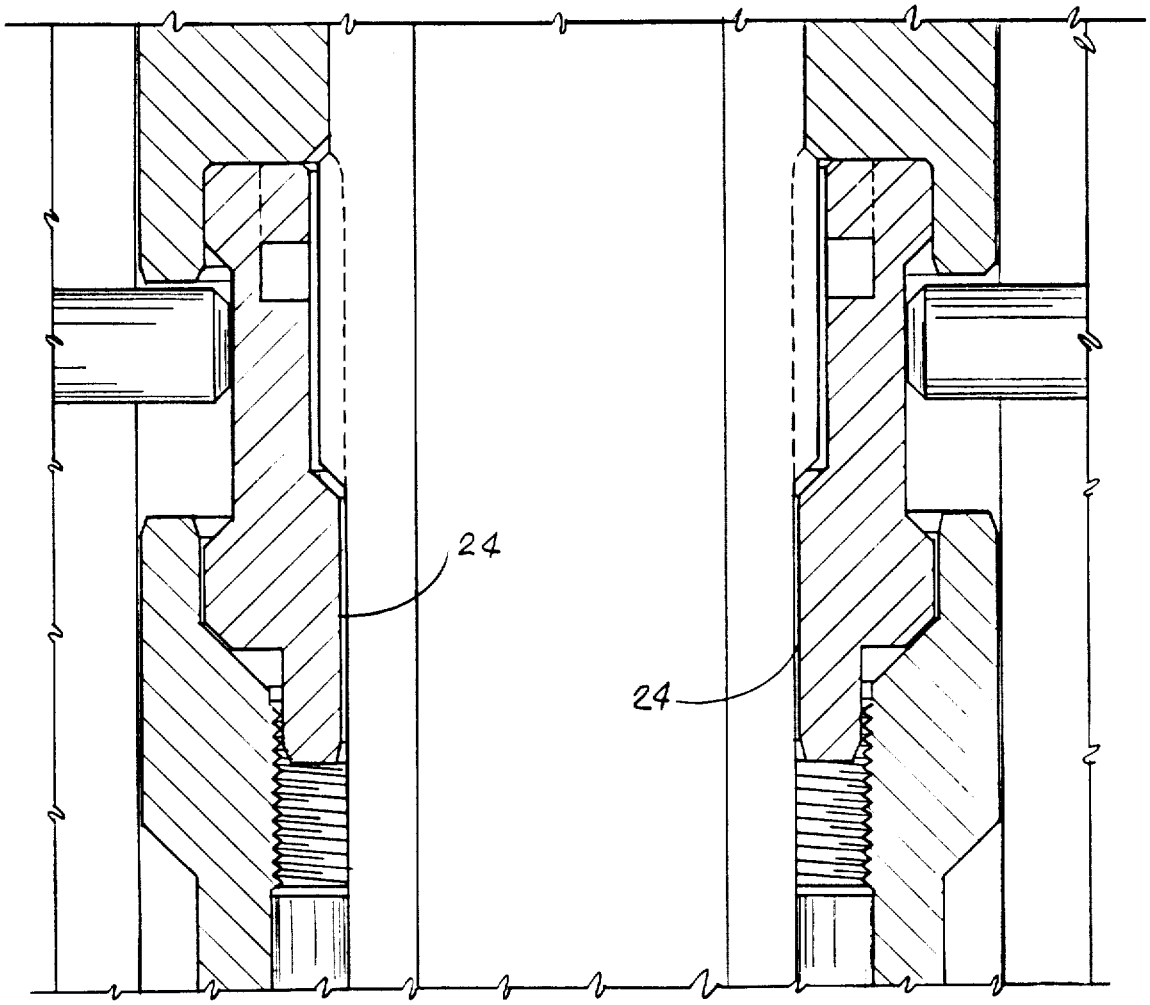
FIG. 4 is another sectional view of the improved wellhead assembly illustrating the support of the tubing string in tension.

As shown in FIG. 3, when the lower end of tubing string 52 is set in the preselected location below wellhead assembly 10, tension is exerted on string 52 until its landing shoulder 54 is above inner upwardly facing landing shoulders 56 of segments 24. In this position, tubing string 52 is under slightly more tension then is to be held when it is supported by bowl assembly 16. Thereafter energizing pins 48 are threaded inward to their second stops, as hereinafter described, which moves segments 24 inward to the position shown in FIG. 3. Then tubing string 52 is lowered so that landing bowl assembly 16 is moved downwardly until its lower tapered shoulder 58 seats on internal seat 22 of seat assembly 14 as shown in FIG. 4.

Figure 6:
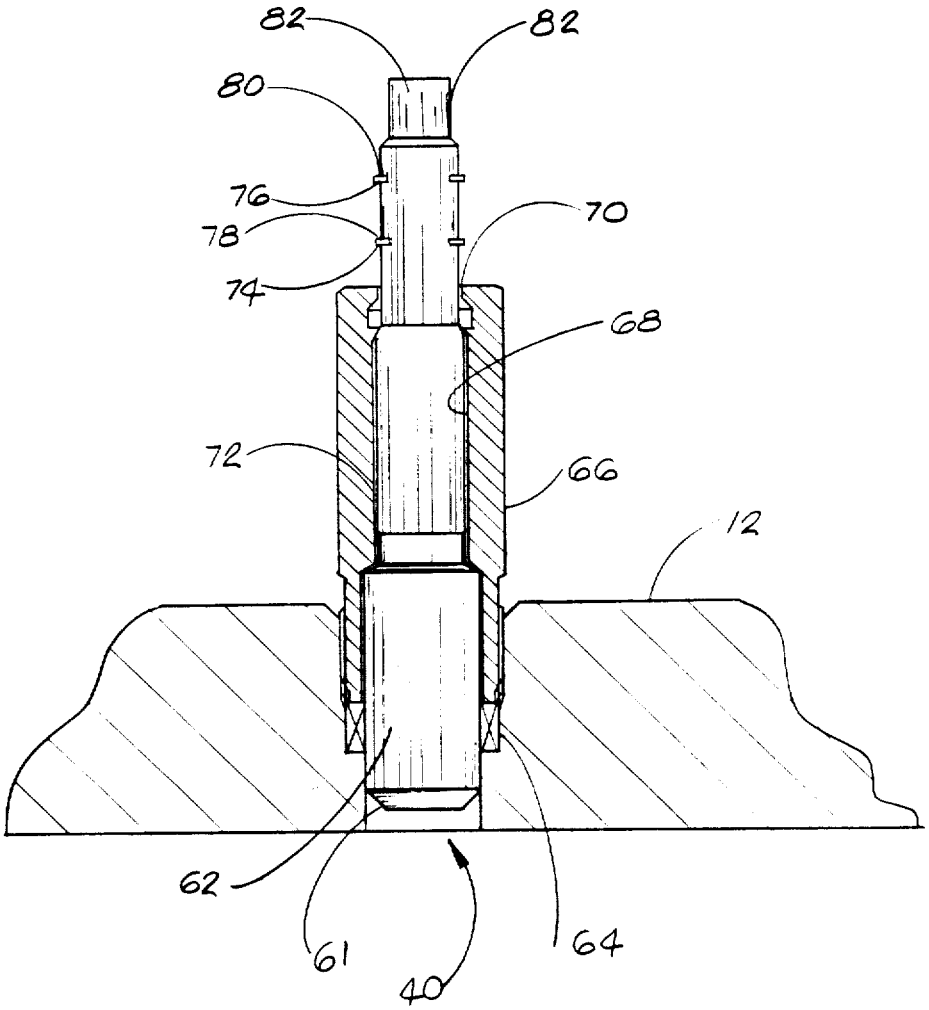
FIG. 6 is a sectional view of one of the energizing pins used with the improved wellhead assembly of the present invention.

Energizing pins 48 are shown in detail in FIG. 6. Each of pins 48 has a tapered inner end 61, with a smooth exterior surface 62 for sealing engagement with seal 64 which is held in place by gland 66. The interior of gland 66 is threaded at 68 and its outer portion provides stop shoulder 70. The intermediate portion of pins 48 includes threads 72 which engage threads 68 so that rotation of pin 48 moves it in and out of wellhead 12. Grooves 74 and 76 around the outer portion of pin 48 receive split retainer rings 78 and 80, which when engaging shoulder 70, function as first position stop and second position stop, respectively. Retainer ring 78 is removed when it is desired to move pin 48 to its second stop position. The outer end of pin 48 includes flats 82 so that pin 48 is easily rotated from the exterior of wellhead 12.

Said energizing pins 48 when moved inward to their first stop position engage in recess 50 of landing bowl assembly 16 and retain bowl assembly 16 in its position as shown in FIG. 2 on lip 20. Further inward movement of pins 48 to their second stop position as shown in FIG. 3 moves bowl segments 24 inward of lips 20 so that when landing shoulder 54 of tubing string 52 engages shoulder 56, bowl assembly 16 is free to move downward onto seat 60.

What is claimed is:

1. A wellhead assembly comprising:

a wellhead member;

means providing an upper outer shoulder and an inner lower shoulder within said wellhead member;

a landing bowl assembly supported by said upper outer shoulder and having at least two segments, means connecting the segments and means biasing the segments outward;

said landing bowl assembly having an inner landing shoulder adapted to receive and support a tubing string landing shoulder when said segments are moved inward;

a plurality of pins threaded through said wellhead member above said shoulders;

means on said pins providing a removable first stop position and a second stop position, said pins when in said first stop position engaging the exterior of said segments and when in said second stop position moving said segments inward; and said pins when moved to said second stop position moving said segments radially inward past said upper outer shoulder to their tubing string supporting position above said inner lower shoulder whereby said segments are loaded by the tubing string and moved onto said inner lower shoulder to support said tubing string within said wellhead member.

2. A wellhead assembly according to claim 1 wherein said segments in their outer position allow a tubing string to be run therethrough.

3. A wellhead assembly according to claim 1 wherein said connecting and biasing means includes pins extending into recesses in opposed faces of said segments, springs biasing said pins outward, and stop means preventing the ends of said pins from moving out of said recesses.

4. In a wellhead assembly having a wellhead member with an upper inner shoulder and a lower internal seat and energizing pins extending therethrough above said shoulders, a landing bowl assembly comprising:

at least two arcuate segments;

pins extending into recesses in opposed faces of said segments;

springs biasing said pins outward;

stop means preventing the ends of said pins from moving out of said recesses;

said pins and said springs interconnecting facing ends of said segments so that the segments form a bowl shape and resiliently urging the segments radially outward;

said landing bowl assembly when in its radially outward position engaging the outer of said shoulders to allow a tubing string to pass therethrough; and said landing bowl assembly when moved radially inward by said energizing pins is above said lower internal seat to receive a tubing string and move onto said lower internal seat to support a tubing string in tension.

* * * * *